United States Patent [19]

Wallerstein

[11] 4,202,093

[45] May 13, 1980

[54] LOW COST, RENEWABLE SCRAPING IMPLEMENT

[76] Inventor: Martin A. Wallerstein, 29 Oakwood Ave., Norwalk, Conn. 06851

[21] Appl. No.: 885,885

[22] Filed: Mar. 13, 1978

[51] Int. Cl.[2] ..... A47L 13/08
[52] U.S. Cl. ..... 30/169
[58] Field of Search ..... 30/169, 333, 170, 171; 15/256.51

[56] References Cited

U.S. PATENT DOCUMENTS

| | | | |
|---|---|---|---|
| 1,704,376 | 3/1929 | Teasdale | 30/169 |
| 2,081,320 | 5/1937 | Burgess | 15/256.51 |
| 3,027,641 | 4/1962 | Leonardson | 30/169 |

FOREIGN PATENT DOCUMENTS

| | | | |
|---|---|---|---|
| 137464 | 5/1934 | Austria | 30/169 |
| 681383 | 10/1952 | United Kingdom | 30/169 |

*Primary Examiner*—Jimmy C. Peters
*Attorney, Agent, or Firm*—Kramer and Brufsky

[57] ABSTRACT

A low cost scraping implement has a wooden or plastic handle with a recess in one surface. A square of plate glass, metal or plastic is held in the recess by a wood retaining plate. A carriage bolt is received in aligned openings drilled through the handle member and the retaining plate. A wing nut threaded onto the shank of the carriage bolt draws the retaining plate towards the handle member to clamp the glass square in place. The glass square can be repositioned within the recess to present eight different scraping edges. A worn or broken glass plate can be readily replaced to renew the scraper.

3 Claims, 3 Drawing Figures

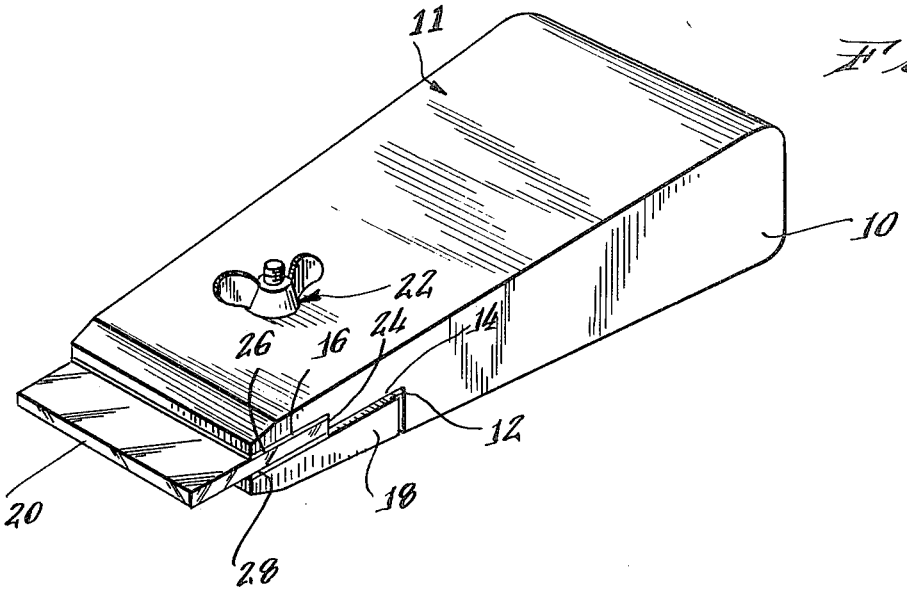
Fig. 1.
Fig. 2.
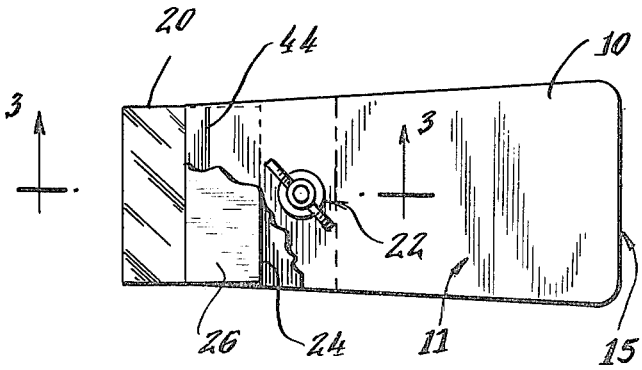
Fig. 3.
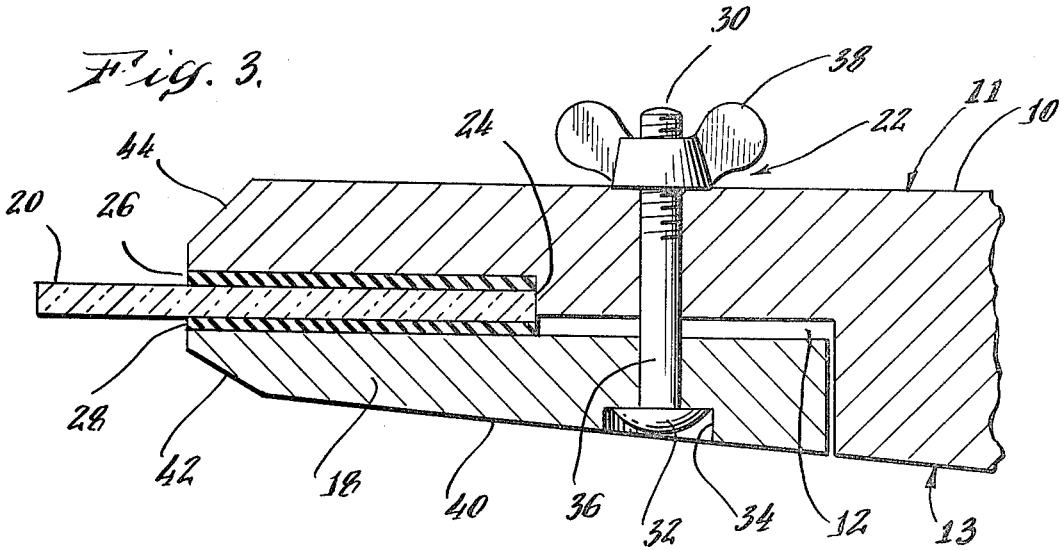

LOW COST, RENEWABLE SCRAPING IMPLEMENT

BACKGROUND OF THE INVENTION

The present invention relates to scraping implements and more particularly to a low cost, renewable scraping implement.

Scraping devices are used for a number of different purposes. Such devices may be used to remove loose paint prior to re-painting an object. A related use is in removing varnish or other protective coatings from furniture which is being refinished. But perhaps the most common and well known use for scraping implements is in removing accumulated ice or snow from the windows of motor vehicles. In colder climates, a sturdy ice scraper is considered an indispensable item by almost all motorists.

Many different types of scrapers have been developed for these and other purposes. Scrapers intended for use in removing paint or varnish have largely been made of metal because of the stresses placed on such scrapers and because of the requirement that the scraping edge remain sharp for a relatively long time.

Scrapers intended for use in removing ice and snow from windows of motor vehicles have largely been made of plastic materials. Low cost scrapers have for the most part been one piece molded items. More expensive scraper elements have been made from harder plastic materials such as Plexiglass. The plastic material might be used for the entire scraper or be used in the form of a permanent insert.

One problem with known low cost scrapers is that the material tends to wear quickly or to shatter under load. Thus, the entire scraping implement has to be frequently replaced.

While more expensive scrapers tend to last longer, their obvious drawback is that they cost more initially.

Moreover, because particular scrapers have been developed for particular purposes, they are often unsuited for other purposes due to the choice of materials and the scraper configuration. Thus, no known scraper can realistically be described as a multi-purpose scraper.

SUMMARY OF THE INVENTION

The present invention is a scraping implement having the low cost of molded plastic scrapers, the durability of more expensive scrapers and the added advantage that it can be employed for different purposes without changing the scraping element. The scraping implement is renewable in that a worn or broken scraping element can either be repositioned or readily replaced with another identical low cost element.

In a preferred embodiment of the invention, the scraping implement includes a handle member having a recess in one surface. The recess extends to at least one edge of the handle member. A retaining member is adapted to be seated against the surface of the handle member including the recess. A polygonal scraping element is received in the recess with at least one edge of the scraping element exposed. Releasable securing means are provided for drawing the retaining member toward the handle member to clamp the scraping element in place.

DESCRIPTION OF THE DRAWINGS

While the specification concludes with claims particularly pointing out and distinctly claiming that which is regarded at the present invention, further details of a preferred embodiment of the invention may be more readily ascertained from the following detailed description when read in conjunction with the accompanying drawings wherein:

FIG. 1 is a perspective view of a scraping implement constructed in accordance with the present invention;

FIG. 2 is a top view of the scraping implement of FIG. 1; and

FIG. 3 is a cross sectional view taken along lines 3—3 of FIG. 2.

DETAILED DESCRIPTION

Referring to FIG. 1, a scraping implement constructed in accordance with the present invention includes a unitary, essentially wedge shaped handle 10 which can be shaped from wood or a suitable synthetic material such as plastic. The right end of handle 10 includes a pair of opposed, converged sides 11 and 13 which provide a comfortable, contoured grip for a user and defines an essentially flat working surface 15 on one end thereof. The left end of handle 10 includes a recess 12 having two levels. The first level of recess 12 includes a surface 14 while the second level is relatively deeper, having a surface 16. A vertical wall 24 connects the two surfaces 14 and 16. A retaining member 18 is adapted to be seated in the recess 12. Scraping member 18 is preferably made from the same material as the handle member 10 and has external contours which match the external contours of the handle member.

A renewable scraping element 20 is seated in the recess 12 between the surface 16 and the inner surface of the retaining member 18. A releasable securing means 22 is employed to draw the retaining member 18 towards the surfaces 14 and 16 of the handle member 10 to clamp the element 20 in place.

Referring also to FIG. 2, it can be seen that the renewable scraping element 20 is preferably a square of a suitable material. In a preferred embodiment, the material would be plate glass which is relatively inexpensive notwithstanding its strength and ability to retain a sharp scraping edge. While other polygonal shapes could undoubtedly be used, a square plate is preferred since it can be repositioned within the recess 12 to provide four different scraping surfaces on each surface. Since scraping edges exists at both the top and bottom surfaces of a square element, such an element can be repositioned to provide a total of eight different scraping edges. In addition, the innermost edge of the square element can be firmly seated against the inner vertical wall 24 of the recess to prevent the element from wobbling during use.

According to a preferred embodiment, the scraping element 20 is sandwiched between a pair of resilient pads 26 and 28 made from a material such as rubber which can absorb shocks that might tend to shatter the element material if it were rigidly mounted. Preferably, the thickness of element 20 plus the combined thicknesses of pads 26 and 28, when under compression, is slightly greater than the height of wall 24.

FIG. 3 shows the resilient pads 26 and 28 and the details of the recess formed in handle member 10 with the pads in their non-compressed state. In a preferred embodiment of the invention, the releasable securing means 22 comprises a headed bolt 30 having a head 32 received within a counterbore 34 in the retaining member 18 and a threaded shank 36 extending through aligned openings in retaining member 18 and handle member 10. A retaining element, such as a wing nut 38, is threaded onto the shank 36 to draw the retaining member towards the handle member. Since the combined thicknesses of the glass plate 20 and the resilient pads 26 and 28 are slightly greater than the height of vertical wall 24, the retaining member, when tightened, firmly holds the glass plate 20 in place. When the wing nut 38 is tightened, the gap between the surface 14 and the facing surface of the retaining member will be reduced.

It will be noted that the outer surface 40 of the retaining member 18 is generally tapered and is further beveled at 42 at the left end of the implement. Similarly, the left end of handle member 10 has a bevel 44. The tapered and beveled surfaces permit a user to hold the scraper at a comfortable angle relative to a surface to be scraped without causing the handle member 10 or the retaining member 18 to strike the surface.

The replaceable glass scraping element can be used for different purposes such as scraping ice or removing loose paint. If desired, squares of material having special properties, such as flexible or rigid metal, might be used in place of the glass scraping element for specialized scraping tasks. The cost of adapting the scraping implement to the special uses is relatively low since only the scraping element itself is changed.

While there has been described what is considered to be a preferred embodiment of the invention, variations and modifications therein will occur to those skilled in the art once they become acquainted with the basic concepts of the invention. Therefore, it is intended that the appended claims shall be construed to include all such variations and modifications as fall within the true spirit and scope of the invention.

What is claimed is:

1. A hand held renewable scraping implement comprising:

a unitary, wedge shaped handle member having a pair of opposed sides converging toward each other at one end thereof, the opposite end of said sides being joined together to form an essentially flat working surface, said handle member including first and second recessed areas therein adjacent said one end of said handle member, said first recessed area extending deeper into said handle member than said second recessed area and extending the entire length of one edge of said handle member, said first recessed area including a first abutment wall opposing said one edge and extending essentially parallel to the latter, said second recessed area being disposed between said working surface and said first recessed area and adjacent the latter, said second recessed area extending to one of said opposed sides of said handle member and including a second abutment wall opposing said one edge and extending parallel to the latter;

a retaining member adapted to be received within said second recessed area and extending between the latter and said one edge of said handle member in overlaying opposed relationship to each of said recessed areas, said handle member and said retaining member including aligned openings therein;

a polygonal scraping element comprising a sheet of glass having a plurality of scraping edges, said scraping element being received within said first recessed area between said handle member and said retaining member with one of said scraping edges thereof being disposed beyond said one edge of said handle member and extending in a direction essentially parallel with said working surface, and another of said scraping edges in abutment with said first abutment wall along essentially the entire length of the latter;

first and second resilient pads respectively interposed between said scraping element and said handle member, and between said scraping element and said retaining member; and releasable securing means extending through said aligned openings in said handle member and said retaining member to urge the latter toward the former whereby to clamp said scraping element.

2. The implement of claim 1, wherein said handle member includes another pair of opposed sides extending from said working surface and converging toward each other adjacent said one end of said handle member, and said scraping element is square in shape.

3. A hand held renewable scraping implement comprising:

a handle member having a recess therein extending along one edge thereof;

a four sided, essentially square scraping element comprising a sheet of glass providing a pair of opposed scraping edges along one of said sides thereof and disposed within said recess of said handle member;

a retaining member adapted to be secured to said handle member adjacent said recess in the latter;

first and second shock-absorbent, resilient pads disposed within said recess of said handle member and respectively interposed between said scraping element and said handle member and between said scraping element and said retaining member, for providing shock-absorbent mounting of said scraping element on said handle member; and releasable securing means operably coupled with said retaining member and with said handle member for urging the former toward the latter whereby to clamp said scraping element therebetween, said handle member comprising a unitary, wedge shaped construction having a pair of opposing sides converging twoard each other at one end thereof adjacent said scraping element, the opposite end thereof defining a flat working surface, said recess being defined by an abutment wall in said handle member extending essentially parallel to said one side of said scraping element and engaging essentially the entire length of the side of said scraping element opposite said one side thereof.

* * * * *